US006305261B1

(12) United States Patent
Romanini

(10) Patent No.: US 6,305,261 B1
(45) Date of Patent: Oct. 23, 2001

(54) HAND-HELD TOOL FOR CUTTING WITH HIGH PRESSURE WATER

(76) Inventor: Alan J. Romanini, 446 McNeil Dr., Sagamore Hills, OH (US) 44067

( * ) Notice: Subject to any disclaimer, the term of this patent is extended or adjusted under 35 U.S.C. 154(b) by 0 days.

(21) Appl. No.: 09/274,991

(22) Filed: Mar. 23, 1999

Related U.S. Application Data

(60) Provisional application No. 60/079,025, filed on Mar. 23, 1998.

(51) Int. Cl.[7] ..... B26D 3/00; B24C 1/00

(52) U.S. Cl. ..... 83/53; 83/98; 83/177; 451/38; 451/102

(58) Field of Search ..... 83/53, 98, 177; 299/17; 239/124, 525, 530, 526; 604/150

(56) References Cited

U.S. PATENT DOCUMENTS

| | | | | |
|---|---|---|---|---|
| 4,272,017 | * | 6/1981 | Franz | 83/53 |
| 4,716,849 | * | 1/1988 | Conn et al. | 114/222 |
| 4,784,330 | * | 11/1988 | Hammelmann | 239/526 |
| 4,802,313 | * | 2/1989 | Smith | 451/90 |
| 4,854,544 | * | 8/1989 | Blase et al. | 251/245 |
| 5,092,362 | * | 3/1992 | Yie | 137/596.1 |
| 5,097,731 | * | 3/1992 | Vives et al. | 83/53 |
| 5,118,080 | * | 6/1992 | Hartmann | 251/229 |
| 5,505,653 | * | 4/1996 | Nedo et al. | 451/5 |
| 5,588,593 | * | 12/1996 | Boisture | 83/177 |
| 5,732,884 | * | 3/1998 | Jauner | 239/288.3 |

FOREIGN PATENT DOCUMENTS

| | | | | |
|---|---|---|---|---|
| 3708608 | * | 2/1988 | (DE) | 83/177 |
| 0198800 | * | 8/1990 | (JP) | 83/177 |

OTHER PUBLICATIONS

Applicant, d/b/a/ Completesource, Inc., is involved in a lawsuit dealing with subject matter related to the claimed invention.
Deposition of Robert Meszaros.
Plaintiff's Exhibit 8.

* cited by examiner

*Primary Examiner*—M. Rachuba
(74) *Attorney, Agent, or Firm*—Porter, Wright, Morris & Arthur

(57) ABSTRACT

A cutting apparatus for cutting using a pressurized jet of fluid from a high pressure fluid source includes a hand-held tool, a hose for delivering pressurized fluid to the hand-held tool from the high pressure fluid source, and a nozzle at a distal end of the hand-held tool. The nozzle has a channel capped by a jewel. The jewel has a second channel therethrough restricting the flow of fluid through the channel, thereby creating the pressurized jet of fluid. A trigger switch is located on the hand-held tool. The trigger switch activates the high pressure fluid source when depressed and deactivates the high pressure fluid source when released.

13 Claims, 6 Drawing Sheets

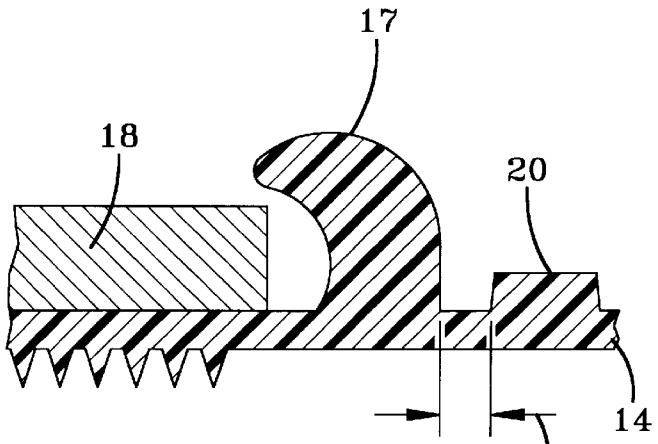
FIG-6c
FIG-6a
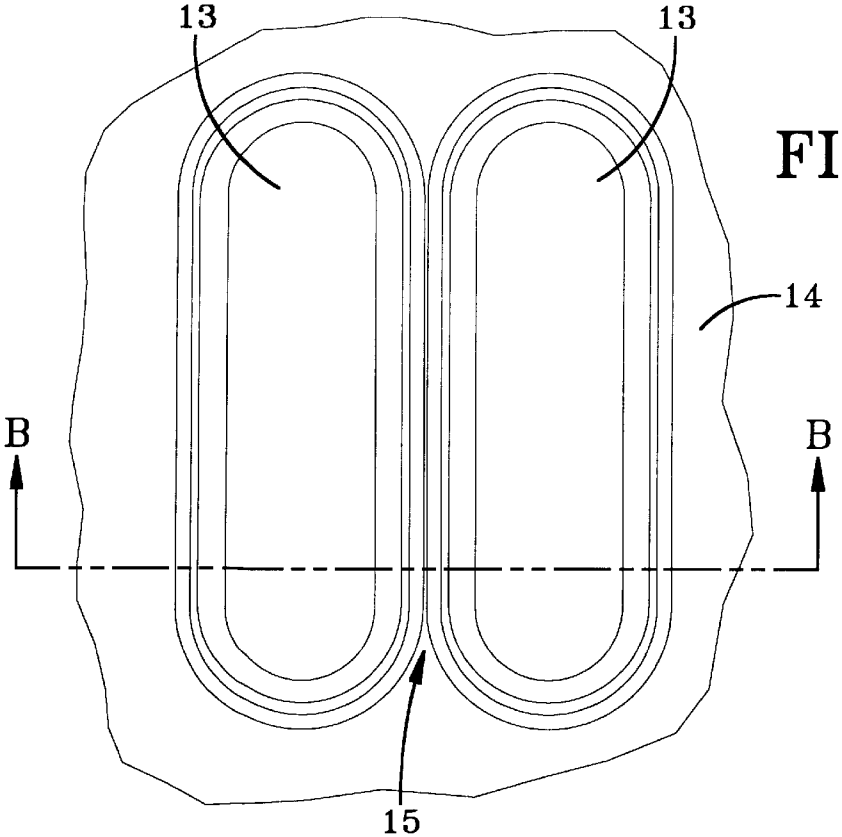
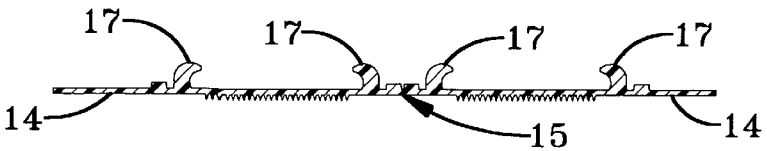
FIG-6b

HAND-HELD TOOL FOR CUTTING WITH HIGH PRESSURE WATER

This application claims priority from U.S. provisional patent application Ser. No. 60/079,025, filed on Mar. 23, 1998.

BACKGROUND OF THE INVENTION

1. Field of Invention

The present invention relates to the field of water jet cutting. More particularly, the present invention relates to a hand-held device for cutting by means of high pressure water and methods for using said tool for cutting soft, deformable materials such as automotive floor mats, foams, plastics, rubber, composites, food products and the like.

2. Description of the Related Art

Cutting various materials by means of jets of high pressure water is a well known technique in modern manufacturing engineering. Focused jets of high pressure water from 2,000 pounds per square inch pressure ("psi") or less, up to 60,000 psi or more, are capable of cutting virtually any material. Thick sheets of steel are capable of being cut by means of high pressure water, as are much thinner sheets of soft or sticky material inconveniently cut by mechanical means. Cutting by means of water jets has several advantage including: sufficiently high quality cut providing for sharp inside corners, reduction in or elimination of slag or burr following the cutting operation (typically requiring a subsequent "deburring" operation following conventional cutting procedures), highly accurate contouring resulting in less wasted material, and water jet cutting allows the cut to be initiated at any point along the path to be cut on the workpiece.

The customary term in the field is "water jet cutting." However, abrasive additives may be added to the stream of water comprising the jet to increase cutting effectiveness (although wear on the nozzle is likewise increased). For the cutting of metals, abrasive grit is typically added to the stream after the jet is formed but prior to the impact of the jet on the workpiece. Water jets including abrasives can accomplish the cutting of intricate slots, through cuts and curves cut in metals, glass, stone, composites and similar materials.

Fluids other than water can also be employed if materials cannot be in contact with water but cutting with a jet of fluid is still the preferred cutting technique. For economy of language we will refer herein to "water jet cutting" or "high pressure water" and the like, not intending to exclude cutting by jets of fluid other than water, and not intended to exclude jets of fluid containing abrasive or other additives.

The typical technique for cutting by means of water jets is to mount the piece to be cut (hereinafter "workpiece") in a suitable jig, die or other means for securing the workpiece into position. One or more water jets are typically directed onto the workpiece to accomplish the desired cutting, generally under computer or robotic control. The cutting power is typically generated by means of a single intensifier connected to the cutting head through high pressure tubing, hose, piping, accumulators and filters. Typical units may have powers of 20 horsepower ("hp"), 50 hp, 60 hp up to 75 hp.

The typical mode of water jet cutting is to employ a single water jet cutting head, but this is not an inherent limitation. A fine stream of water, typically travelling at two to three times the velocity of sound, is directed onto the workpiece.

The stream of cutting fluid is typically pinhole size in diameter, but a jet slightly larger than (1/16) inch in diameter produces nearly 50 hp when concentrated. Hereinafter we will refer to workpiece and cutting tool in the singular, not intending thereby to exclude the use of a plurality of cutting heads and/or a plurality of workpieces.

It is not necessary to keep the workpiece stationary and to manipulate the water jet cutting tool. The workpiece can be manipulated under a stationary cutting jet, or both the water jet and the workpiece can be manipulated to facilitate cutting. However, increasing the separate degrees of motion to be executed by the workpiece and/or cutting head, increases the complexity of the robotic manipulation system.

This automated cutting process has some drawbacks as conventionally implemented. Among these are the need for mounting the workpiece for processing and removing the cut portions following processing. These steps can increase processing time, although typically several workpieces may be mounted at once for sequential or concurrent processing in the water jet cutting apparatus. Another disadvantage lies in the need for reasonably precise specification of the path the cutting apparatus is to take over the workpiece. The location of the cutting jet in space and the direction of the exiting jet require, in general, six numbers for complete specification; three for location in space and three for orientation. Additionally, the path of movement must be specified which, in its full generality, requires the specification of each of the six spacial and angular orientation coordinates as functions of time. This is most commonly accomplished by means of CAD/CAM programming to identify and plot the passage of the water jet cutting head over the workpiece so as to produce the desired finish form and edge quality.

Jet on-off controls must also be specified as well as any pressure changes of the cutting fluid that are made during the cutting process. Thus, robotic control of the process may be a complex procedure, justified if numerous workpieces of the same geometry are to be processed in the same way.

A more serious drawback to robotic or automated water jet cutting is the variability in dimension and characteristics from workpiece to workpiece. This disadvantage shows itself quite clearly in the process of cutting materials for use as floor mats in cars, trucks and other vehicles. These materials tend to have small (but important) variations in dimension from workpiece to workpiece even when processed in the same manner prior to cutting. These variations can occur from irregular quantities of individual compounds being mixed to produce the workpiece, although understanding the source of such imperfections and variations in the workpieces is not necessary in the practice of the present invention.

These materials are also subject to deformation and changes in dimension during processing, making reproducible cutting difficult by means of robotic or computer controlled water jets. Individual compounds in the workpiece may react differently to various processing conditions, tending to fuse the material through heating and deform during the cool-down period following processing. Additionally, these materials must typically be cut in locations and along paths not easily accessed by means of computer controlled cutting jets.

The present invention contemplates a new and improved hand-held tool for cutting with high pressure water that is simple in design, effective in use, and overcomes the foregoing difficulties and others while providing better and more advantageous overall results.

SUMMARY OF THE INVENTION

In accordance with the present invention, a new and improved cutting apparatus that uses pressurized fluid is provided that is hand held.

According to one aspect of the present invention, a cutting apparatus for cutting using a pressurized jet of fluid from a high pressure fluid source includes a hand-held tool, a hose for delivering pressurized fluid to the hand-held tool from the high pressure fluid source, and a nozzle at a distal end of the hand-held tool. The nozzle has a channel capped by a jewel. The jewel has a second channel therethrough restricting the flow of fluid through the channel, thereby creating the pressurized jet of fluid.

According to another aspect of the present invention, a cutting apparatus for cutting using a pressurized jet of fluid from a high pressure fluid source includes a hand-held tool, a hose for delivering pressurized fluid to the hand-held tool from the high pressure fluid source and a nozzle at a distal end of the hand-held tool that restricts the flow of pressurized fluid to create a pressurized jet of fluid when pressurized fluid passes. The cutting apparatus further includes an electrical switch box containing a switch for supplying power to the cutting apparatus, a trigger switch on the hand-held tool operatively connected to the electrical switch box, an electrical relay switch operatively connected to the trigger switch, and a pneumatic solenoid valve for supplying air to the cutting apparatus connected to the electrical relay switch. The pneumatic valve is activated by the electrical relay switch when the trigger switch is depressed. The cutting apparatus also includes a pneumatic valve connected to the high pressure fluid source and the pneumatic solenoid valve. The pneumatic valve prevents flow of high pressure fluid to the hand-held tool when the trigger switch is disengaged. The pneumatic valve is opened by air received from the pneumatic solenoid valve through a hose when the pneumatic solenoid valve is activated by the electrical relay switch.

Still other benefits and advantages of the invention will become apparent to those skilled in the art to which it pertains upon a reading and understanding of the following detailed specification.

For definiteness of expression, we will describe the present invention in terms of cutting materials for automotive floor mats. However, as will be clear from the detailed description of the invention herein, there are many other areas of application for the device of the present invention and it is not limited to use in connection with automotive floor mats.

The present invention relates to a hand-held tool for water jet cutting and the use of this tool in the process of cutting materials for automotive floor mats. The hand cutting tool is expected to find application in numerous processing applications where the variable and/or deformable geometry of the workpiece is more suited to human operation than to computer control. However, the cutting of automotive floor mats is a commercially significant endeavor in its own right, and the process for cutting such mats is also a part of the present invention.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

Figure 1:
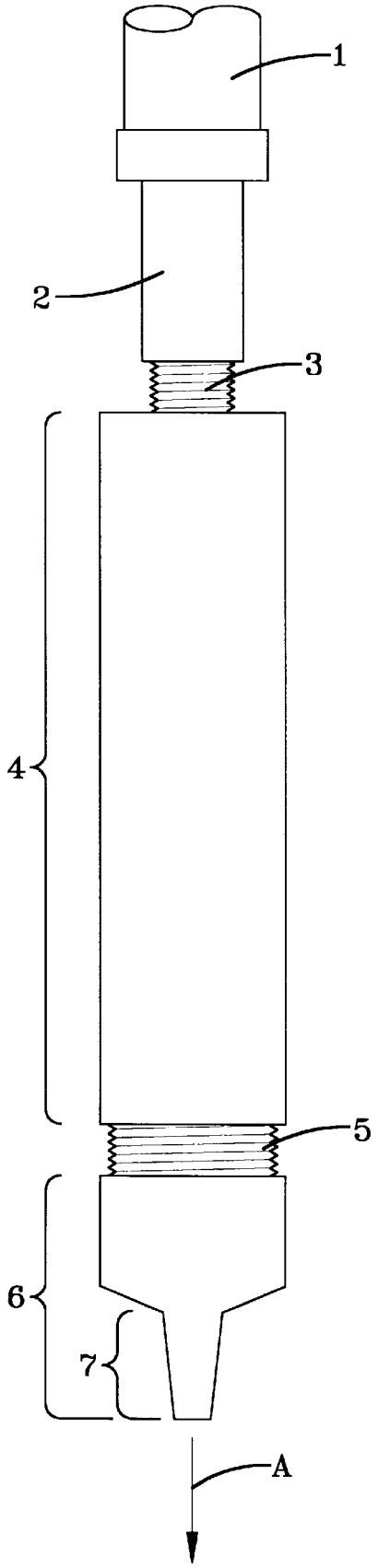
FIG. 1 is a side view of the hand-held water jet cutting tool of the present invention.
Figure 2:
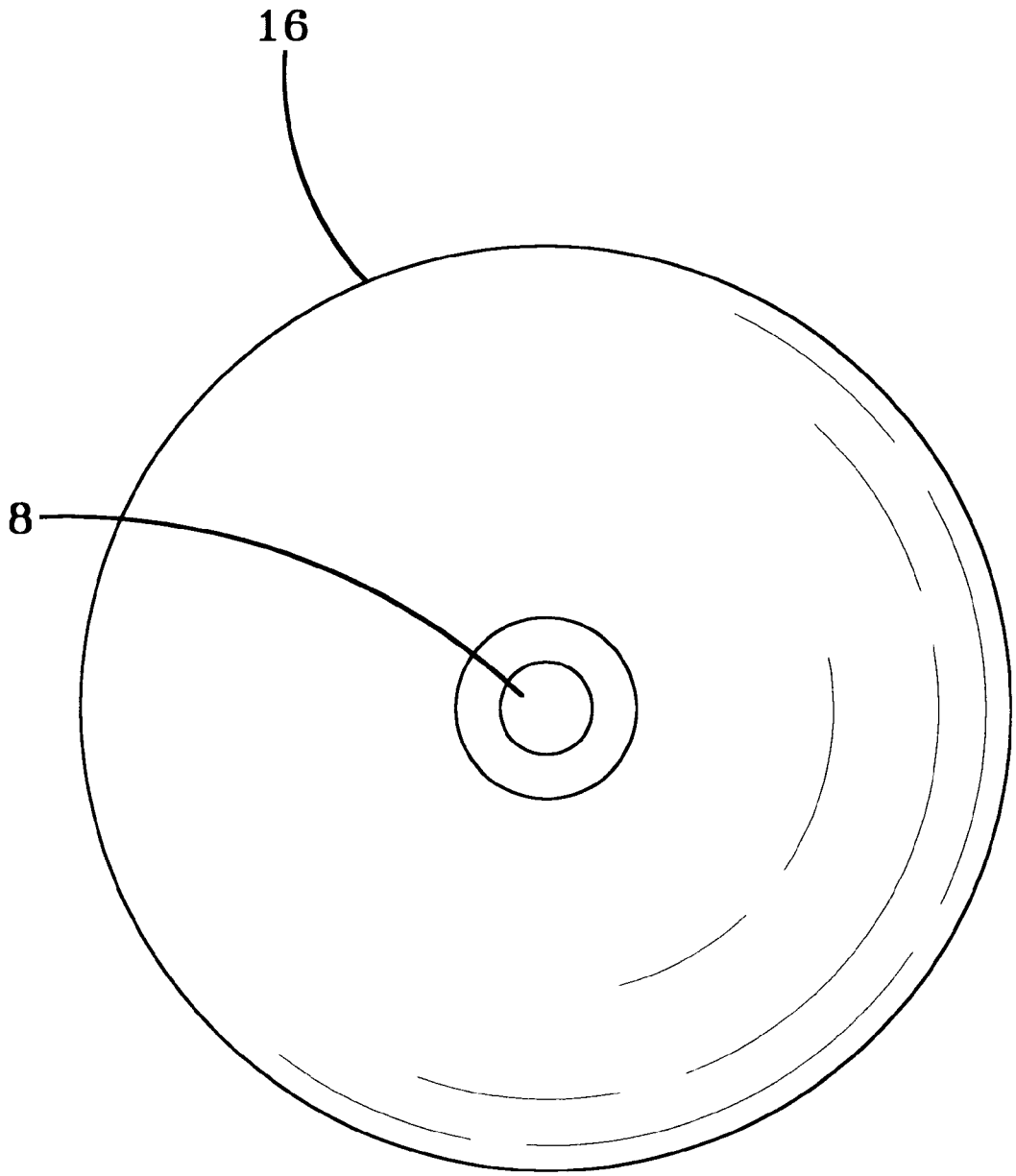
FIG. 2 is an end view of the hand-held water jet cutting tool of the present invention looking into the nozzle from which the cutting water exits in direction "A" of FIG. 1.
Figure 3:
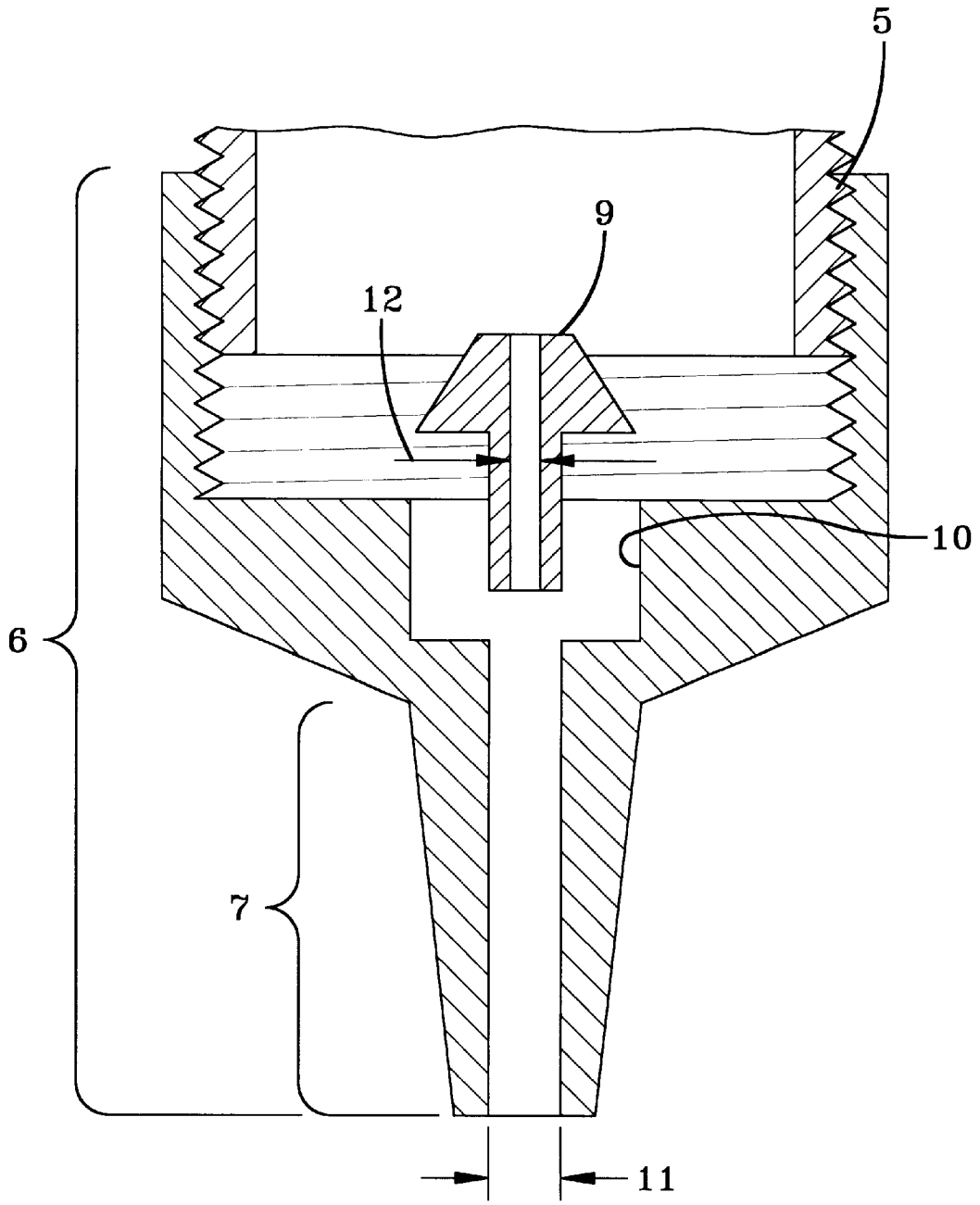
FIG. 3 is a detail cut-away view of the valve controlling the cutting water as it exits from the hand-held cutting device.
Figure 4:
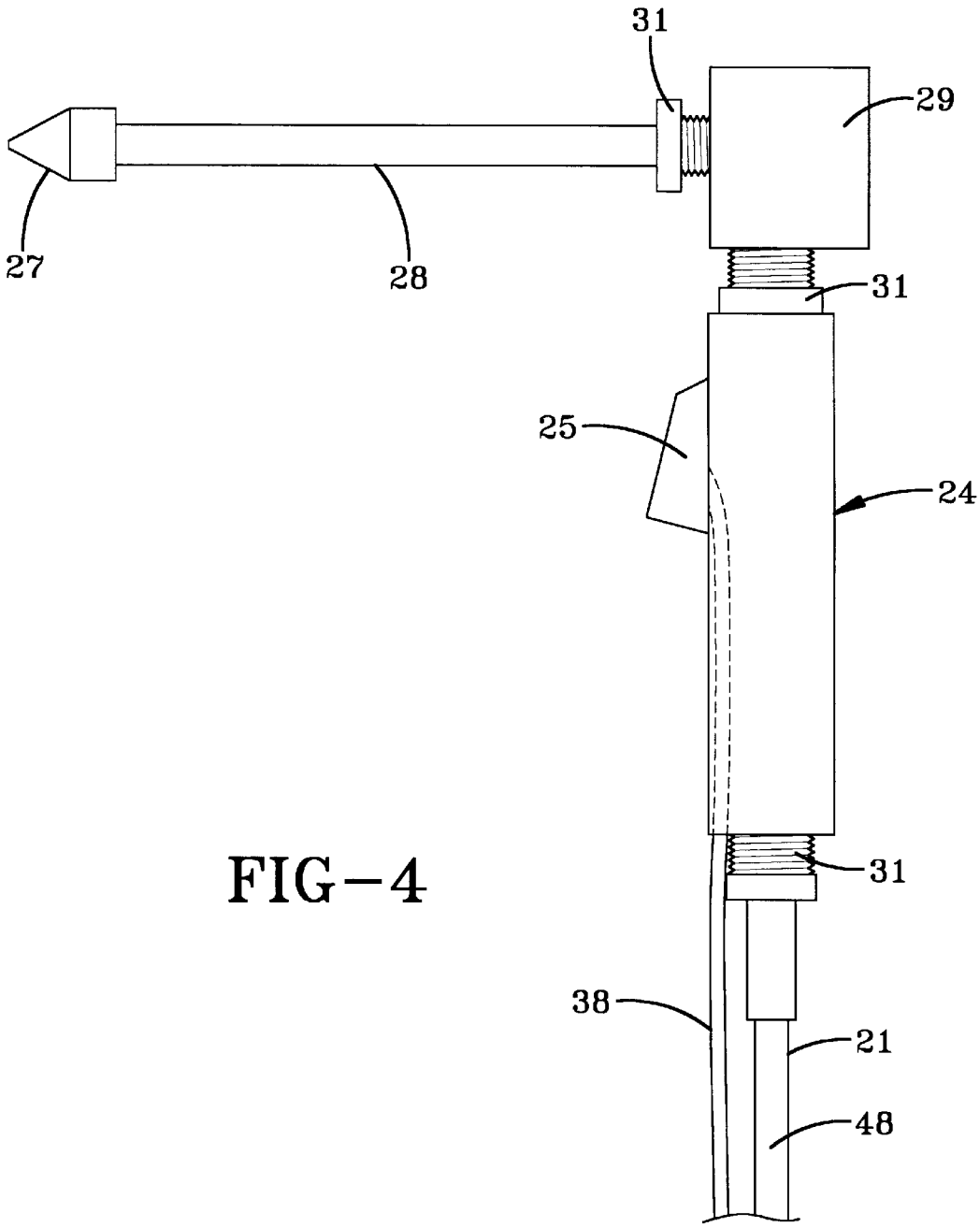
Figure 5:
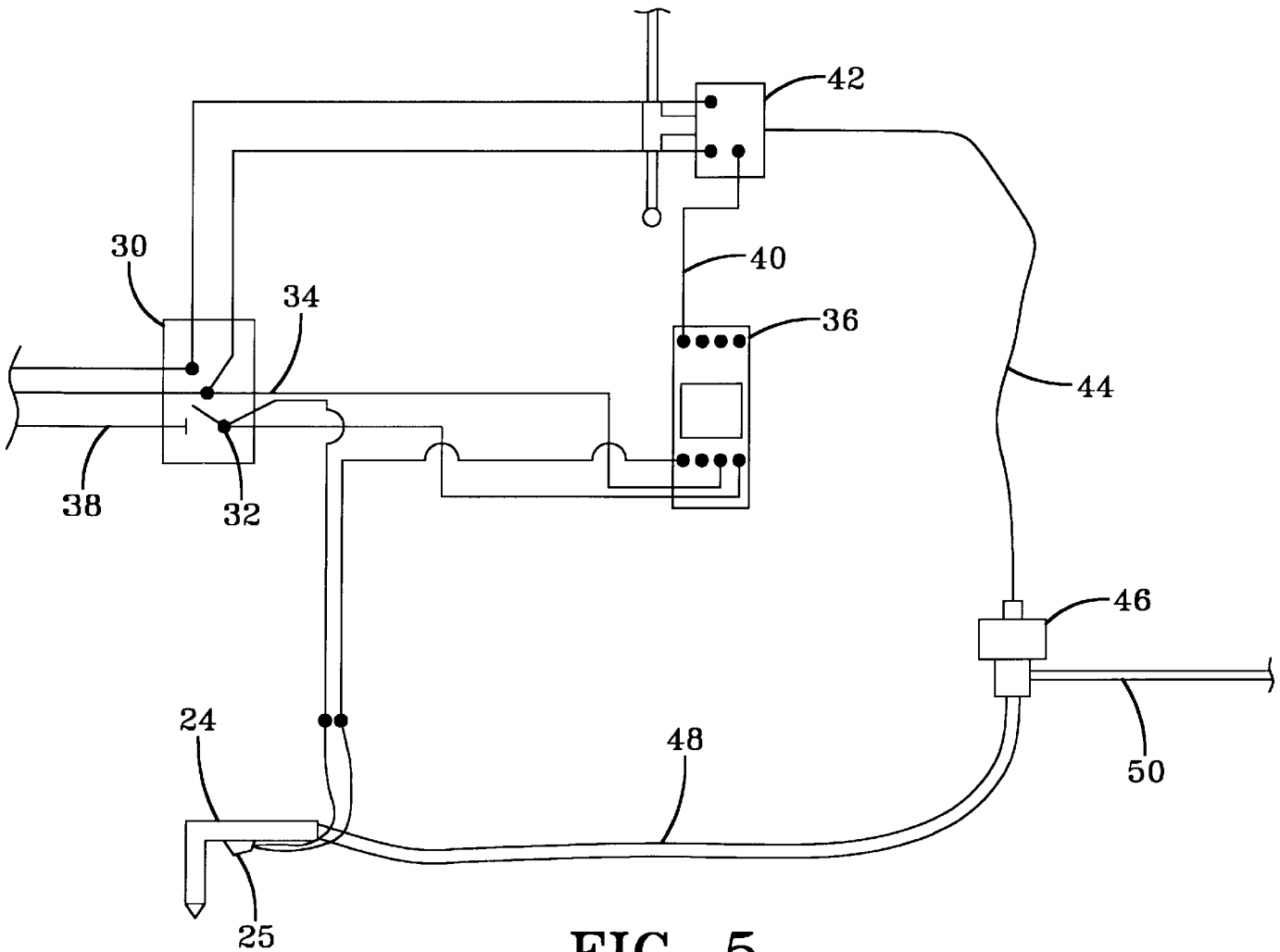

The square cross-hatching in FIGS. 1, 2 and 3 is background only and not a part of the present invention;

FIG. 4 is a side view of and alternate embodiment of the hand-held water jet cutting tool that includes and on/off trigger switch;

FIG. 5 is a schematic diagram of the hand-held water jet cutting system shown in FIG. 4;

FIG. 6*a* is a top view of typically floor mats as would be presented for cutting;

FIG. 6*b* is a cross-sectional view along "B" in FIG. 6*a* of the region of the floor mats to be cut; and FIG. 6*c* is a magnified segment of FIG. 6*b* showing the region to be cut in cross-sectional detail.

DESCRIPTION OF THE PREFERRED EMBODIMENT

Referring now to the drawings wherein the showings are for purposes of illustrating a preferred embodiment of the invention only and not for purposes of limiting the same, FIG. 1 shows the water jet hand-held cutting tool of the present invention. The cutting fluid is delivered to the cutting tool first through high pressure pipe to a high pressure flexible hose 1, commonly including a section with typically an attached threaded coupling, 2, for increased ease of manipulation and preattached, threaded coupling ends, 3. The connecting hose or pipe, 1, is typically 6 to 10 feet in length to facilitate ease of movement above the workpiece although other convenient lengths may be used without changing the essential features of the present invention.

By means of a threaded or other connector, 3, the high pressure water delivery system is connected with the hand-held device, 4. 4 in FIG. 1 is the portion of the present invention typically held by the operator and generally connected to the cutting head, 6 by means of a threaded or other connector. Hand-held device, 4, is typically 6 to 8 inches in length and constructed with a round or hexagonal cross section for ease of gripping and manipulation, and should provide flat-cut in its surface to allow for gripping by a wrench or other tool when the feeder hose or cutting tip needs to be replaced, typically 1.0625 to 1.125 inches in diameter. However, other shapes, dimensions, geometries, lengths are not excluded in the practice of the present invention and will be selected by one having ordinary skill in the art for convenience and operability.

High pressure water is delivered through tubing and connectors 1, 2 and 3, through the hand-held tool 4 and exits the cutting head, 6 through nozzle 7. In the practice of the present invention, cutting pressures are preferably in the range of approximately 22,000 to 45,000 psi. However, other pressures are not excluded when the cutting tool of the present invention is used in connection with other cutting applications.

It has conventionally been believed that hand-held cutting tools for water jet cutting are not practical because the back-reaction of the cutting tool to the water exiting under such high pressures would create a "fire hose effect" rendering the hand tool difficult to control by a human operator.

However, the present invention demonstrates that this is not the case. The cutting tool of the present invention can be operated over the workpiece with either hand of the operator controlling the path of the cut. The back-reaction to the exiting water depends upon the momentum of the exiting fluid. That is, the back-reaction by the hand tool is determined by the mass of the water ejected from the nozzle per unit time (e. g. gallons per minute) multiplied by the speed at which the mass exits the nozzle (generally increasing with increasing pressure). The size of the orifice in the jewel used in the cutting head, 9 in FIG. 3, determines the quantity of water ejected by the jet during operation. Although the pressure at which the cutting fluid exits the nozzle is high (typically 22,000–45,000 psi for water jet cutting compared with less than about 250 psi for a typical fire hose), the mass of water used in water jet cutting is very small. The opening through which water exits is typically (1/16) to (3/32) inches in diameter, leading to very small quantities of water being ejected per unit time and correspondingly modest recoil of the hand tool. The stream of high velocity pressurized fluid is governed by the orifice in the jewel, ranging from typically 0.004–0.020 inches in diameter but preferably in the practice of the present invention approximately 0.007 inches in diameter. Therefore, contrary to conventional expectations, the hand-held cutting tool of the present invention is readily controlled by an operator by hand.

The nozzle of the present invention is shown in side view as 6 in FIG. 1 and, in FIG. 2, as viewed axially along direction "A" as depicted in FIG. 1 and enlarged axial cross section in FIG. 3. The arrows in FIG. 1 point along the direction of the water flow while the view of FIG. 2 is opposite the direction of the arrows. The outer circumference, 16, is typically configured so as to connect with the hand tool, 6, most commonly by means of threaded male/female connectors, 5, although other types of connectors are not inherently excluded in the practice of the present invention. The tapered nozzle, 7, through which the cutting water exits for cutting is preferably machined substantially in the tapered configuration shown in FIGS. 1, 2 and 3. Conventional water jet cutting nozzles have a rounded shape, substantially similar to a segment of a sphere. These substantially spherical cutting heads of conventional cutting equipment typically have curvatures of spheres around 1.25 inches in diameter, although diameters as small as (5/8) to (3/4) inches are possible. One novel feature of the present invention is the use of the tapered nozzle of FIGS. 1, 2 and 3 in combination with the hand-held cutting device of the present invention. FIG. 2 shows as 7, FIG. 3, the largest circumference of the tapered cutting nozzle at the most upstream portion of the tapered nozzle. 8 in FIG. 2 denotes the exit nozzle, typically (1/16) to (3/32) inches in diameter in one embodiment of the present invention. The tapered configuration of the cutting nozzle of the present invention is particularly useful in cutting difficult to access regions as in the case of floor mats, but not limited to substantially flat workpieces only.

FIG. 3 shows a cross sectional cut-away side view the nozzle 6. Tapered portion, 7, results in an exit diameter, 11, of about (1/16) to (3/32) inches. In one embodiment of the present invention, the high pressure cutting water exits through orifice 11 by means of an elongate channel, 12 which is one piece of the jewel that delivers the high pressure cutting water through exit orifice, 11. Channel, 10, is typically capped by a movable "jewel," 9, substantially in the shape depicted in FIG. 3. The jewel seats into the body of the cutting head and restricts the seepage of pressurized fluid from paths other than travel down the channel. This restriction forms the exiting stream of water as it passes through the orifice in the jewel and down the channel exiting the tip, 11 of FIG. 3. Jewel, 9 controls the flow of the high pressure water to the cutting tip and nozzle, 11. In the practice of the present invention, it is found that jewels having a channel diameter, 12, of around 0.005 to 0.024 inches provide the desired effects, with a channel diameter 12 between 0.005 and 0.010 inches being preferred. Although other sizes are used in some applications, the stated range of sizes are found to be most favorable in the practice of the present invention.

The device of the present invention is conveniently used for cutting a variety of materials by hand manipulation of cutting head 6 as attached to handle, 4. In operation, there would also be a means for the operator to control the flow of the water through the device and out nozzle 7. This could be a hand operated on-off valve as a conventional "T valve," a foot controller or any other convenient means for controlling the flow of cutting water as known to those having ordinary skills in the art.

FIG. 4 shows an alternate embodiment of the present invention where the hand-held device 24 has an on/off trigger switch 25. When the trigger switch 25 is depressed, the hand-held device 24 is activated. When the on/off trigger 25 is disengaged, the hand-held device 24 is deactivated. With continuing reference FIG. 4, FIG. 5 shows a schematic of the electrical and water supplies to the hand-held device 24.

The electrical power, preferably 120 volts, is fed into an electrical box 30. It is a safety feature of the present invention that the electrical box 30 has a switch 32 to complete the circuit and pass current beyond when the switch 32 is in a closed position. The neutral lead 34 attaches to an electrical relay switch 36. The hot, or load line 38, after the switch 32, passes along to the same electrical relay switch 36, which is another safety feature of the present invention. In one preferred embodiment of the invention, the electrical relay switch 36 used is a Potter & Bromfield KAP-5AG-120 1 120V 50/60 HZ, 1/6 hp, 10A 120VAC-1–3 hp, 10A 240VAC. Another load line 40 branches directly to the trigger switch 25 on the hand-held device 24. The neutral lead 34 splits and travels to a pneumatic air solenoid valve 42. A grounding connection is made at this point with the air solenoid valve 42, which is yet another safety feature of the present invention. The air solenoid valve 42, or pneumatic valve, is preferably supplied with plant air in addition to a load line 40 from the switch connection on the electrical relay 36. The available plant air is locked out of the air solenoid valve 42 until the electrical relay switch 36 allows the air solenoid valve 42 to function and allow air to pass, which is another safety feature of the present invention. From this point, the plant air is routed through a preferably flexible line 44 that travels to a high pressure pneumatic on/off valve. The on/off valve 46 controls the passage of high pressure water 50 to the high pressure flexible hose 21,48 through the hand-held device 24. The hand-held device 24, as illustrated in FIG. 4, also has a load line 38.

To operate the system, air is supplied to air solenoid valve 42, but it does not pass valve 42. Electricity is switched on a switch box allowing current to pass to the trigger switch 25 on the hand-held device 24 and to the electronic relay switch 36. An intensifier (not shown) is turned on and brought up to desired water pressure, which feeds high pressure water through line 50 to the on/off valve 46, but the water is held back at the on/off valve 46. When the trigger switch 25 on the hand-held device 24 depressed, the circuit is now closed over to the electrical relay switch 36 through load line 38.

Switch 36 activates the pneumatic air solenoid valve 42, opening the path for pressurized air to flow through line 44 to the on/off valve 46. The air supply to the on/off valve 46 lifts the valve opening the flow of water into the high pressure hose 48 leading to the hand-held device 24. From this point on the hand-held device operates in the same manner as the previous embodiments previously discussed.

In the preferred embodiment of the invention, the hand-held device 24 is made of a plastic and acrylic composite, and is preferably non-conductive. This is yet another safety feature in the present invention to prevent the possibility of an electrical shock while using the hand-held device 24. The hand-held device 24, as shown in FIG. 4, also has a right angle orientation to facilitate use as a high precision cutting tool. The nozzle 27 is at the end of a piece of high pressure tubing 28. A high pressure, right angle block 29 directs the flow of high pressure fluid towards the nozzle 27. In the preferred embodiment, all of the components of the hand-held device 24 are connected by high-pressure couplers 31.

FIG. 6*a* depicts a top view of typical automotive floor mats as would be cut using the device and methods of the present invention. The floor mats, 13, are typically molded in sheets containing multiple mats. FIG. 6*a* depicts two floor mats on a single sheet although other numbers (perhaps four, or even one mat per sheet) are also contemplated within the scope of the present invention. The floor mats are molded out of suitable plastic or polymer material in a configuration for later attachment to the appropriate carpet. The final product is thus the molded mat with carpet attached ready for use in a consumer's vehicle. The present invention is concerned with the fabrication and finishing of the mat into the size, geometry and form suitable for having the carpet attached thereto and not with the process for attaching carpet.

FIG. 6*a* depicts a typical molded sheet containing (in this example) two floor mats. The floor mats are denoted by 13 in FIG. 6*a*. The molding process typically results in the final floor mats, 13, leaving the initial molding process surrounded a region of by relatively thin scrap material or "flashing," 14 in FIG. 6*a*. One purpose of the present invention is to cut and trim the sheet containing the floor mats depicted in FIG. 6*a* such that the scrap material is removed, the individual mats are separated from the sheet, the geometry of the mats is shaped making the mats ready for attachment of the carpet, and the finished floor mats are aesthetically pleasing. The hand-held water jet cutting apparatus of the present invention and method of cutting floor mats therewith meets these objectives in an improved manner over typical cutting devices and methods of the prior art.

FIG. 6*b* is a cross-sectional view along line B in FIG. 6*a*. The flashing region, 14, surrounding the floor mats is depicted both in FIGS. 6*a* and 6*b*. The region between the two mats is denoted by 15 on FIGS. 6*a* and 6*b*. FIG. 6*c* depicts an magnified view of the cross-sectional edge region of one of the floor mats. The flashing region to be removed is again denoted by 14 in FIG. 6*c*. 17 is a molded attaching hook that is used to hold the carpet into position. Often the carpet is glued to the floor mat in the region surrounded by the attaching hook, 17. But even in such cases, hook, 17, is needed to keep the carpet in position while the adhesive sets, to shield the interface between the carper and floor mat from shearing forces tending to tear or separate the carpet from the mat while in use. We show as 18 in FIG. 6*c* the location where the carpet is to be attached to the floor mat. It is understood however, that the carpet, 18, is included in FIG. 6*c* merely for clarity of depiction. Typically, no carpet is present during the use of the present invention although this is not an inherent limitation in the practice of the present invention. 18 in FIG. 6*c* shows merely where the carpet will later be attached.

The typical floor mat contains, in addition to hook, 17, an elevated separator, 20 and region 19 between hook, 17 and separator, 20. Region 19 is commonly referred to as the "cut path" and is typically approximately 0.020–0.040 inches in width, or less. A precise cut along 19 is required to provide an aesthetically pleasing floor mat. In practice, the dimension of the floor mats may vary slightly from one to another, making automated cutting difficult to perform to the required precision. In addition, the shielded nature of the cut path as a valley between the attachment hook, 17 and the separator, 20 makes precision cutting by conventional non-abrasive water jet cutting equipment difficult.

The present invention provides a hand-held water jet cutting tool having a narrow nozzle tip, 11, suitable for riding on top of the cut path, 19. The hand-held device of the present invention is favorably configured for manually traversing cut path, 19 around the entire circumference of the mat. The narrow geometry of the nozzle tip of the present invention allows the operator, during the manual traverse of the cut path, to maintain a precise cut. Manual cutting by means of the device and process of the present invention allows a precise cut to be obtained despite variations in the floor mat from cut to cut; despite variations in the geometry of the mat as the entire circumference of the cut path, 19, is traversed; and despite deformations of the mat by mechanical and/or thermal effects before or during the cutting process. The present invention allows for the cutting head to be drawn around the variable workpieces with the tapered nozzle in contact therewith and resting in the designed cut path, and allowed to follow the preferred and designed contours with an improved standard edge cutting quality in the resulting cut. The net result is a rapidly cut floor mat with uniformly high precision from workpiece to workpiece. Prior art cutting can lead to workpiece rejection rates up to around 50%, primarily due to imprecise cuts leading to aesthetically unacceptable appearance in the final cut product. Use of the present invention reduces rejection rates to typically less than around 3% with no material reduction in production throughput.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

I claim:

1. A method of cutting an object with a cutting apparatus for cutting using a pressurized jet of fluid from a high pressure fluid source, comprising the steps of, in combination:

providing a cutting apparatus comprising a hand-held tool, a hose for delivering pressurized fluid to said hand-held tool from said high pressure fluid source, and a nozzle at a distal end of said hand-held tool, said nozzle directing the flow of pressurized fluid to create a pressurized jet of fluid when pressurized fluid passes said nozzle having a tapered portion with a frusto-conically shaped outer surface sized and shaped for direct contact with the object and an exit nozzle located at a small diameter end of the tapered portion;

supplying electrical power to a relay switch;

contacting the object with the tapered portion of the nozzle;

depressing a trigger switch on said hand-held tool, thereby supplying power to a pneumatic solenoid valve, said pneumatic solenoid valve opening and supplying air to a pneumatic valve connected to said high pressure fluid source and said pneumatic solenoid valve, said pneumatic preventing flow of high pressure fluid to said hand-held tool when said trigger switch is disengaged, said pneumatic valve being opened by air received from said pneumatic solenoid valve through a hose when said pneumatic solenoid valve is activated by depressing said trigger switch; and, cutting said object by moving the nozzle along the object while maintaining contact with the object and directing said pressurized jet of fluid from said hand-held tool at said object along a cut path.

2. The method of claim 1, further comprising the step of providing a molded floor mat as the object to be cut, the molded floor mat having material to be removed by cutting.

3. The method according to claim 2, wherein the step of providing a molded floor mat further comprises the step of providing a molded floor mat with a pair of parallel and spaced apart protrusions defining the cutting a path therebetween.

4. The method according to claim 3, wherein the step of providing a molded floor mat with a pair of parallel and spaced apart protrusions includes providing a cut path of less than 0.040 inches.

5. The method according to claim 3, wherein the step of providing a molded floor mat with a pair of parallel and spaced apart protrusions includes providing a hook protrusion and a spacer protrusion.

6. The method according to claim 3, wherein the step of providing a cutting apparatus includes providing the nozzle portion with a size and shape which permits the nozzle to be moved along the protrusions with the nozzle in contact with the floor mat and resting in the cut path.

7. The method according to claim 6, wherein the step of cutting the object includes cutting the object along the cut path within a tolerance of +/−0.020 inches.

8. The method according to claim 1, further comprising the step of providing the object to be cut having at least one protrusion and the step of contacting the object with the tapered portion of the nozzle includes the step of contacting the protrusion with the tapered portion of the nozzle so that moving the nozzle along the protrusion defines the cutting a path therebeside.

9. The method according to claim 8, wherein the step of providing the object to be cut with at least one protrusion includes the step of providing the object to be cut having a pair of parallel and spaced apart protrusions defining the cutting path therebetween.

10. The method according to claim 9, wherein the step of providing a cutting apparatus includes providing the nozzle portion with a size and shape which permits the nozzle to be moved along the protrusions with the nozzle in contact with the object and resting in the cut path.

11. The method according to claim 9, wherein the step of providing the object to be cut having a pair of parallel and spaced apart protrusions includes providing a cut path of less than 0.040 inches.

12. The method according to claim 1, wherein the step moving the nozzle along the object comprises manually moving the nozzle.

13. The method according to claim 12, wherein the step of cutting the object includes cutting the object along the cut path within a tolerance of +/−0.020 inches.

* * * * *